United States Patent [19]

Kaltmann

[11] 3,952,657

[45] Apr. 27, 1976

[54] RIFLE CARTRIDGE

[75] Inventor: Hans-Joachim Kaltmann, Dusseldorf, Germany

[73] Assignee: Rheinmetall GmbH, Dusseldorf, Germany

[22] Filed: Apr. 11, 1974

[21] Appl. No.: 460,137

[30] Foreign Application Priority Data

Apr. 21, 1973 Germany ..... 2320399

[52] U.S. Cl. ..... 102/38; 102/93; 102/DIG. 1

[51] Int. Cl.[2] ..... F42B 5/02

[58] Field of Search ..... 102/38, 93, 39, 43 P, 102/DIG. 1, 49.1, 49.2

[56] References Cited

UNITED STATES PATENTS

| | | | |
|---|---|---|---|
| 2,798,433 | 7/1957 | Allan | 102/93 |
| 3,410,213 | 11/1968 | Stadlei | 102/39 |
| 3,435,765 | 4/1969 | Gawlick | 102/39 |
| 3,446,147 | 5/1969 | Engel et al. | 102/93 |
| 3,527,137 | 9/1970 | Scanlon | 102/38 |
| 3,728,966 | 4/1973 | Woodring | 102/38 |
| 3,741,122 | 6/1973 | Kordas, Jr. | 102/DIG. 1 |

FOREIGN PATENTS OR APPLICATIONS

| | | | |
|---|---|---|---|
| 1,297,569 | 5/1962 | France | 102/38 |

*Primary Examiner*—Samuel W. Engle
*Assistant Examiner*—Harold Tudor
*Attorney, Agent, or Firm*—Ernest G. Montague; Karl F. Ross; Herbert Dubno

[57] ABSTRACT

A cartridge includes a projectile which is inserted in a plastic shell receiving a propellant charge and the cartridge is expelled out of a barrel by propellant gases. The present invention resides in that the plastic shell is formed with a drive cage for a subcaliber projectile.

4 Claims, 5 Drawing Figures

RIFLE CARTRIDGE

FIELD OF THE INVENTION

The present invention relates to a cartridge.

BACKGROUND OF THE INVENTION

For many decades it has been attempted to develop socalled "shell-less" ammunition. By shell-less it is meant that after the firing of the cartridge, no shell need be separately removed from the weapon. Thus the cartridge can consist only of the projectile and the completely burning charge connected with it. However, it has been found that such ammunition leads to difficulties in actual practice; the catridges are very sensitive to impact and therefore unsuitable for automatic weapons, since the charge breaks or detaches itself from the bullet, and in addition there is the danger of self-ignition upon introduction of the cartridge into the weapon which is hot from previous firing. Finally, such ammunition is extremely sensitive to external influences.

For this reason it has been attempted to protect the propellant charge from these effects.

In particular, the projectile has been extended towards the rear in the form of a hollow body which receives the propellant charge. This made the manufacture of the cartridge more difficult and resulted in an unfavorable shape of the projectile. Furthermore, this solution is in opposition to the desire to decrease ther weight of the cartridge to a minimum in order to increase the readiness for firing and, for a given weight, to increase the number of shots which can be carried.

A large number of such solutions have been discussed in the article "Shell-Less Ammunition for Small Arms and Machine Guns" in the Wehrtechnische Monatshefte 1956, page 366.

German Offenlegungschrift No. 1,958,925 describes a cartridge having a shell of plastic; this construction is therefore not shell-less in the sense of entirely eliminating the presence of a shell, but satisfies the aforementioned requirements, since, while the shell is not consumed, it is ejected automatically through the barrel of the gun by the propellant gases and accordingly need not be withdrawn from the breech.

In this cartridge, the full-caliber projectile is forced into a depression in the open side of the shell or bonded therein; the diameter of the shell thus exceeds the caliber of the weapon (barrel-bore diameter) by a considerable amount. To this extent there is similarity with the customary cartridges. Under the action of the gases of the propellent charge, the shell is destroyed and discharged through the barrel of the gun; in order to assure this, a predetermined break point is provided. The danger that parts will remain in barrel is always present with this cartridge.

This construction has various disadvantages. First, the shooting results may not be reproducible, since the energy required for the expulsion and prior crushing of the shell tends to vary from shot to shot. One important disadvantage is that despite bonding to the plastic shell, the projectile can detach itself from the shell, particularly if, in case of misfire, the cartridge must be removed from the chamber since the projectile can then jam in the riflings of the barrel.

OBJECT OF THE INVENTION

The object of the present invention is to provide a cartridge whose projectile is received in a plastic shell which accommodates the propellant charge and is expelled from the barrel by the propellant gases, which cartridge is on the one hand ballistically perfect and on the other hand safe to handle in that removal from the chamber in case of misfiring does not afford any difficulty.

SUMMARY OF THE INVENTION

This object is achieved in accordance with the present invention by forming the plastic shell with a drive cage embracing subcaliber projectile.

As a result of this development, the shell is shot as a single unit out of the barrel upon firing so that the shooting performance is reproducible. In addition there is also obtained as a desirable advantage the increase in power which is a result of the sabot effect. Since the projectile can also not jam in the barrel riflings, the cartridge, in case of misfire, can be removed from the chamber undamaged in the ordinary fashion.

As a further development of the invention, the shell can surround the projectile at least substantially completely; in this way the seating of the projectile in the cage is improved. In order that the shell, shortly after leaving the barrel, is subjected to self-destruction into more harmless fragments, it is formed with suitably arranged points of intended breakage and possibly air inlet apertures at its muzzle end between the cage and the projectile. Upon the impact with the air at the leading end of the shell, radially outward faces are generated and self-destruction then takes place.

In order to reduce frictional losses, gas-pressure relief grooves are provided preferably along the wall of the shell; holes can extend from the bottom of the grooves into the powder chamber of the shell in order to accelerate the equalization of pressure transverse to the wall of the shell.

Upon emergence from the muzzle of the barrel, the rear part of the drive cage is broken by the gas pressure into segments defined between the relief grooves.

The shell can be made of a single piece. For considerations of manufacture, it is, however, advisedly made in two parts. The two parts may be connected together in known manner by friction-welding, or the outer part can be produced by extrusion onto the projectile after its insertion.

Since the propellent charge could absorb moisture at the open chamber end of the shell and also through the holes at the bottom of the relief grooves, should such holes be present, a protective coating is preferably provided at these points. The bottom of the cartridge is closed off from external influences by sealing.

An ordinary circumferential ejector groove can be provided at the chamber end of the shell.

BRIEF DESCRIPTION OF THE DRAWINGS

With the above and other objects and purpose, one preferred embodiment of the cartridge of the invention is shown in the accompanying drawing and will be explained in further detail below. In the drawing.

SPECIFIC DESCRIPTION

Figure 2:
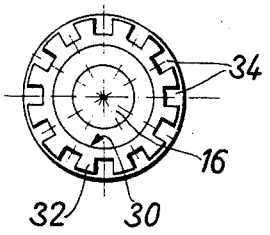
FIG. 2 is an end view looking at the bottom of the cartridge.
Figure 1:
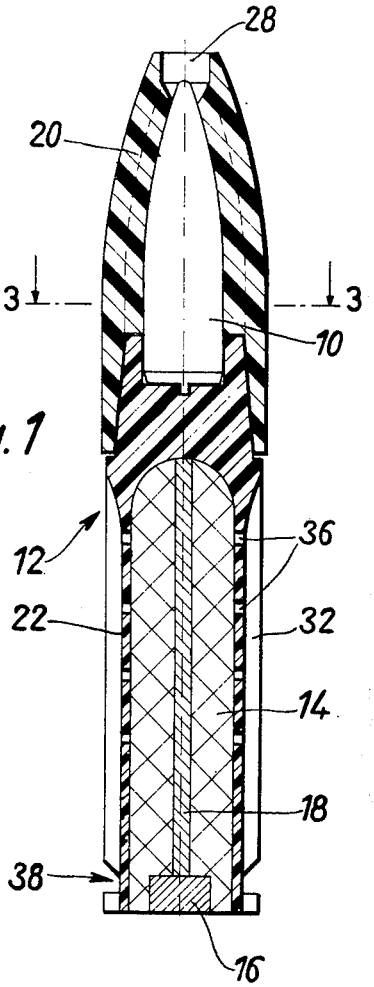
FIG. 1 is a longitudinal section through a cartridge according to the invention.
Figure 3:
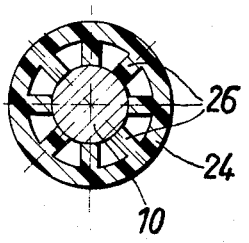
FIG. 3 is a section along the line 3—3 of FIG. 1.
Figure 1A:
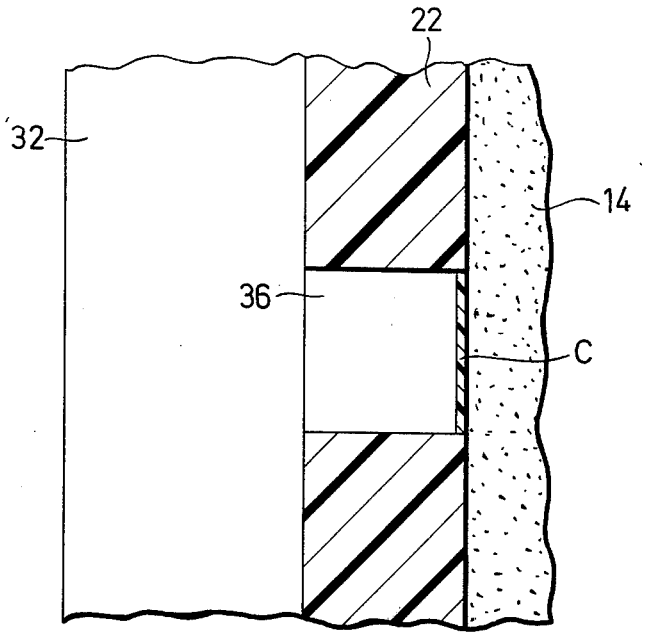
FIGS. 1A and 1B are detail views of portions of FIG. 1 to a larger scale.
Figure 1B:
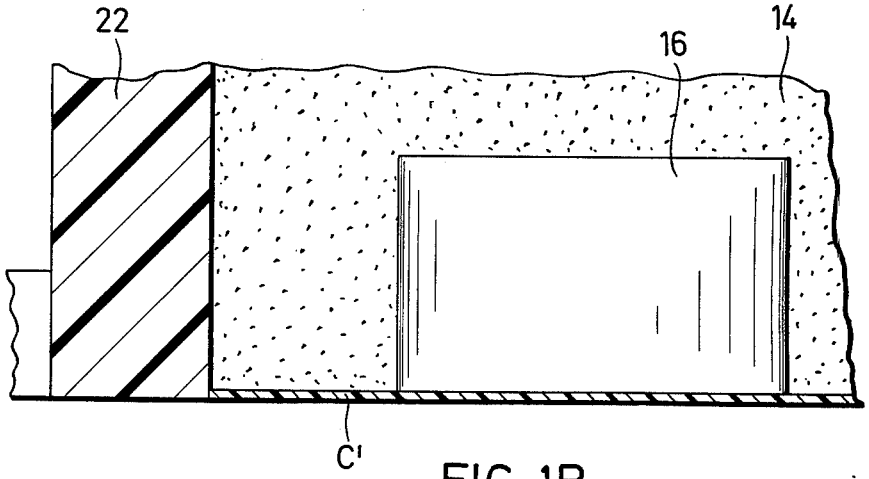

The cartridge consists of the projectile 10, a bipartite shell 12 and propellent charge 14; a primer 16 is located at the chamber end of the charge. A firing charge 18 extends axially through the charge 14. Otherwise the construction and composition of the charge are not essential for an understanding of the invention.

The projectile 10 is subcaliber. The caliber of the weapon corresponds rather to the outside diameter of the shell 12. Upon manufacture, the two parts 20 and 22 of the shell are produced separately by extrusion from plastic (for instance polyethylene). Thereupon the projectile 10 is inserted into the front part 20 which is then connected with the rear part 22 by friction-welding or extrusion thereon.

The front part 20 has a solid (continuous) outer wall 24 which assures guidance within the barrel and has internally radially inward projecting ribs 26 against which the projectile rests. At the tip or leading end an air inlet opening 28 is provided. Upon striking the air at the muzzle, self-destruction takes place, the air being introduced and forced through said opening. The hollow spaces remaining between the ribs 26 form points of breaking for the destruction of the front part of the shell.

The rear part 22 which receives the charge 14 has a solid (continuous) inner wall 30 from which ribs 32 extend radially outward. The relief grooves 34 between the ribs are connected with the powder chamber by small bores 36. In this wax, upon the firing, propellent-charge gases penetrate between the barrel and the wall 30, so that the lateral pressure is reduced and thus the friction between the shell and the barrel is decreased. The open bottom is closed above the primer 16 by a completely burnable covering sheet over which a protective varnish C′, which also covers the bore holes 36C, prevents the penetration of moisture. A circumferential groove 38 is provided as ejection groove at the customary place.

The intended points of breakage for the front part 20 of the shell can also extend from the outside into the wall of the shell, so that instead of a solid outer wall, there is a solid inner wall resting against the projectile.

I claim:

1. A rifle cartridge for firing in a weapon having a barrel, said cartridge comprising:

an elongate projectile having a diameter less than the caliber of said barrel;

a shell of plastic material affixed to said projectile and having a diameter substantially corresponding to the caliber of said barrel, said shell comprising a tubular rear portion extending rearwardly of said projectile and a forward portion substantially enveloping said projectile and forming a sabot therefor, said rear and forward portion being interconnected, said shell being formed with weakened zones enabling separation of said projectile therefrom upon emergence of the cartridge from the barrel, said forward portion being formed with an opening at a leading end of said projectile enabling air to enter between said projectile and said forward portion, said forward portion and said rear portion being each formed with a plurality of angularly spaced radial ribs defining said weakened zones between them, said rear portion being provided with orifices communicating between the interior of said rear portion and the exterior thereof between the ribs of said rear portion to enable pressure equalization across the wall of said rear portion upon ignition of said charge; and a propellant charge received in said rear portion and adapted to ignite upon firing to produce propellant gases driving said projectile and said shell from said barrel.

2. The cartridge defined in claim 1 wherein said ribs of said forward portion project inwardly from a continuous outer wall and said ribs of said rear portion project outwardly from a continuous inner wall, said rear portion having at the trailing end of said cartridge a circumferential groove engageable by a cartridge ejector.

3. The cartridge defined in claim 2 wherein said portions are friction-welded together.

4. The cartridge defined in claim 3 wherein said charge is provided with a protective covering at least in the regions of said orifices.

* * * * *